US009883737B2

(12) United States Patent
Lanphear

(10) Patent No.: US 9,883,737 B2
(45) Date of Patent: Feb. 6, 2018

(54) HEIGHT-ADJUSTABLE TABLE AND METHOD OF ASSEMBLY

(71) Applicant: John Stephen Lanphear, Lawrence, MI (US)

(72) Inventor: John Stephen Lanphear, Lawrence, MI (US)

( * ) Notice: Subject to any disclaimer, the term of this patent is extended or adjusted under 35 U.S.C. 154(b) by 0 days.

(21) Appl. No.: 15/165,618

(22) Filed: May 26, 2016

(65) Prior Publication Data

US 2016/0345723 A1 Dec. 1, 2016

Related U.S. Application Data

(60) Provisional application No. 62/166,145, filed on May 26, 2015.

(51) Int. Cl.

| | |
|---|---|
| ***A47B 85/00*** | (2006.01) |
| ***A47B 13/02*** | (2006.01) |
| ***A47B 13/08*** | (2006.01) |
| ***A47B 9/00*** | (2006.01) |
| ***A47B 17/02*** | (2006.01) |
| ***A47B 19/00*** | (2006.01) |
| ***A47B 21/02*** | (2006.01) |

(52) U.S. Cl.

CPC ..... *A47B 13/023* (2013.01); *A47B 9/00* (2013.01); *A47B 13/088* (2013.01); *A47B 17/02* (2013.01); *A47B 19/00* (2013.01); *A47B 21/02* (2013.01); *A47B 2013/024* (2013.01); *A47B 2200/0003* (2013.01); *A47B 2200/0046* (2013.01); *A47B 2200/0052* (2013.01)

(58) Field of Classification Search

CPC ..... A47B 13/023; A47B 13/088; A47B 9/00; A47B 17/02; A47B 19/00; A47B 21/02; A47B 2013/024; A47B 2200/0003; A47B 2200/0046; A47B 2200/0052

See application file for complete search history.

(56) References Cited

U.S. PATENT DOCUMENTS

| | | | | |
|---|---|---|---|---|
| 351,101 A | | 10/1886 | Fauber et al. | |
| 3,361,508 A | | 1/1968 | Chassevent | |
| 3,538,863 A | * | 11/1970 | Howard | A47F 3/10 108/105 |
| 3,543,699 A | | 12/1970 | Leikarts | |

(Continued)

OTHER PUBLICATIONS

Herman Miller, Inc., "Renew Sit-to-Stand Table Rectangular", Internet <http://store.hermanmiller.com/products/review-sit-to-stand-table-rectangular>.

(Continued)

*Primary Examiner* — Hanh V Tran

(74) *Attorney, Agent, or Firm* — Diederiks & Whitlaw, PLC

(57) ABSTRACT

A height-adjustable table includes a first tabletop and a second tabletop. A first height adjustment mechanism is configured to vertically shift the first tabletop relative to a support surface on which the table is supported. A second height adjustment mechanism is configured to vertically shift the second tabletop relative to the support surface. The table also includes a base in direct contact with the support surface. Each of the first and second height adjustment mechanisms is directly coupled to the base.

13 Claims, 3 Drawing Sheets

(56) References Cited

U.S. PATENT DOCUMENTS 3,565,152 A * 2/1971 Cohn, Jr. ..... A47G 5/00 160/135
3,698,104 A * 10/1972 Sutton ..... A47B 41/00 108/60
4,604,955 A 8/1986 Fleischer et al.
4,667,605 A 5/1987 Bastian
4,734,826 A 3/1988 Wilson et al.
4,836,114 A * 6/1989 Cohen ..... A47B 37/00 108/60
5,044,135 A * 9/1991 Kroon ..... A47B 83/001 108/60
5,065,832 A * 11/1991 Mark ..... A47B 21/06 108/50.02
5,259,326 A 11/1993 Borgman et al.
5,291,700 A 3/1994 Chew
5,363,772 A * 11/1994 Adamidis ..... A47B 9/00 108/66
5,437,235 A * 8/1995 Randolph ..... A47B 21/00 108/25
5,443,017 A * 8/1995 Wacker ..... A47B 9/04 108/147
5,447,099 A 9/1995 Adams et al.
5,715,760 A * 2/1998 Frascaroli ..... A47B 13/023 108/180
5,743,193 A 4/1998 Kakuta et al.
5,848,497 A * 12/1998 Henderson ..... A47B 83/001 108/50.01
7,036,438 B2 * 5/2006 Okamoto ..... A47B 17/02 108/153.1
7,789,025 B2 9/2010 Michaud et al.
8,960,102 B2 2/2015 Rheault et al.
2005/0150437 A1 7/2005 Chen
2006/0096505 A1 * 5/2006 Sykes ..... A47B 21/02 108/50.01
2008/0018211 A1 * 1/2008 Dye ..... A47B 9/02 312/223.3
2014/0238277 A1 8/2014 Fishman et al.
2014/0312754 A1 * 10/2014 Hecht ..... A47B 9/04 312/309
2016/0255950 A1 * 9/2016 Mata Valdes ..... A47B 9/20

OTHER PUBLICATIONS

Workspace Interiors Office Design, "Sit to Stand", Internet <http://www.officedesigns.nz/products/sittostanddesks.aspx>.

* cited by examiner

HEIGHT-ADJUSTABLE TABLE AND METHOD OF ASSEMBLY

CROSS REFERENCE TO RELATED APPLICATIONS

This application claims the benefit of U.S. Provisional Patent Application Ser. No. 62/166,145, which was filed on May 26, 2015 and titled "Multi-Station Height Adjustable Table". The entire content of this application is incorporated herein by reference.

BACKGROUND OF THE INVENTION

The present invention pertains to tables and, more particularly, to multi-station, height-adjustable tables.

Recently, there has been a rise in the popularity of standing desks, i.e., desks that are designed to be used while standing. Such desks are intended to improve health by reducing the amount of time users spend sitting. Another related trend involves standing meetings in which the participants stand instead of sitting around a table. In such situations, it would be beneficial to have a shared table at standing height so that the participants set down documents, electronic devices, etc. Also, tables in public spaces are sometimes intended to be used by multiple people simultaneously. For example, locations, such as airports, now have charging stations where people can charge their electronic devices. These tables are also sometimes placed at standing height. However, as people come in a variety of heights, a single table height is unlikely to be suitable for all of the participants. In view of the above, there is a need in the art for a standing-height table having individual height-adjustable portions so that the table can be comfortably and conveniently shared by multiple people.

SUMMARY OF THE INVENTION

The present invention is directed to a height-adjustable table and a method of assembling the table. The table includes a first tabletop and a second tabletop. A first height adjustment mechanism is configured to vertically shift the first tabletop relative to a support surface on which the table is supported. A second height adjustment mechanism is configured to vertically shift the second tabletop relative to the support surface. The table also includes a base in direct contact with the support surface. Each of the first and second height adjustment mechanisms is directly coupled to the base.

In one embodiment, the table further includes a central post and an accessory directly coupled to the central post. Preferably, the accessory is a sign, a display screen, a light or a shelf. The accessory can be removably coupled to the central post.

In another embodiment, the table further includes a guard configured to eliminate a pinch point located between the first tabletop and the second tabletop. The guard is directly coupled to the central post, and the guard is fixed in place such that the guard does not move when the first and second tabletops are vertically shifted. In still another embodiment, the guard is directly coupled to the first tabletop such that the guard is vertically shifted when the first tabletop is vertically shifted.

In yet another embodiment, the central post is directly coupled to the base. In a further embodiment, a housing is in direct contact with the base, and the housing is configured to at least partially cover each of the first and second height adjustment mechanisms. Preferably, the housing is also configured to at least partially cover the central post.

In one embodiment, the first and second tabletops define at least a portion of a circle when the table is viewed from above. In another embodiment, the table includes a first user interface configured to control the first height adjustment mechanism and a second user interface configured to control the second height adjustment mechanism.

Additional objects, features and advantages of the invention will become more readily apparent from the following detailed description of preferred embodiments thereof when taken in conjunction with the drawings wherein like reference numerals refer to common parts in the several views.

DETAILED DESCRIPTION OF THE PREFERRED EMBODIMENTS

Detailed embodiments of the present invention are disclosed herein. However, it is to be understood that the disclosed embodiments are merely exemplary of the invention that may be embodied in various and alternative forms. The figures are not necessarily to scale, and some features may be exaggerated or minimized to show details of particular components. Therefore, specific structural and functional details disclosed herein are not to be interpreted as limiting, but merely as a representative basis for teaching one skilled in the art to employ the present invention.

In addition, certain objects are described below as being coupled or directly coupled to one another. For purposes of the present invention, direct coupling is intended to encompass: 1) two objects being in direct contact with one another; and 2) two objects being in indirect contact with one another through one or more other objects specifically designed to couple the objects together. This second definition is not intended to encompass a housing, for example, that encloses a variety of different structure. Instead, the second definition is intended to recognize that objects are often coupled to one another through the use of other objects, such as brackets, whose primary purpose is to enable or facilitate coupling.

Furthermore, even though certain objects are described below as defining a portion of a circle, for purposes of the present invention, this does not require that such objects define a portion of a perfect circle. Instead, the terms "circle" and "circular" are defined as including a margin of error of +/−5%. Specifically, these terms encompass ellipses where the maximum and minimum diameters are each within 10% of the mean diameter. The terms "center" and "central" also include a margin of error of +/−5% such that, for instance, the center of a 100 cm long object is located between 45 and 55 cm. In addition, any specific numerical value listed includes a margin of error of +/−5%. Accordingly, a length of 100 cm includes lengths between 95 and 105 cm. Similarly, the terms "horizontal", "vertical", "parallel" and "perpendicular" are defined as including a margin of error of 5° such that an object need not be perfectly horizontal, for example. The term "approximately" increases these various margins to 10% and 10°.

Figure 1A:
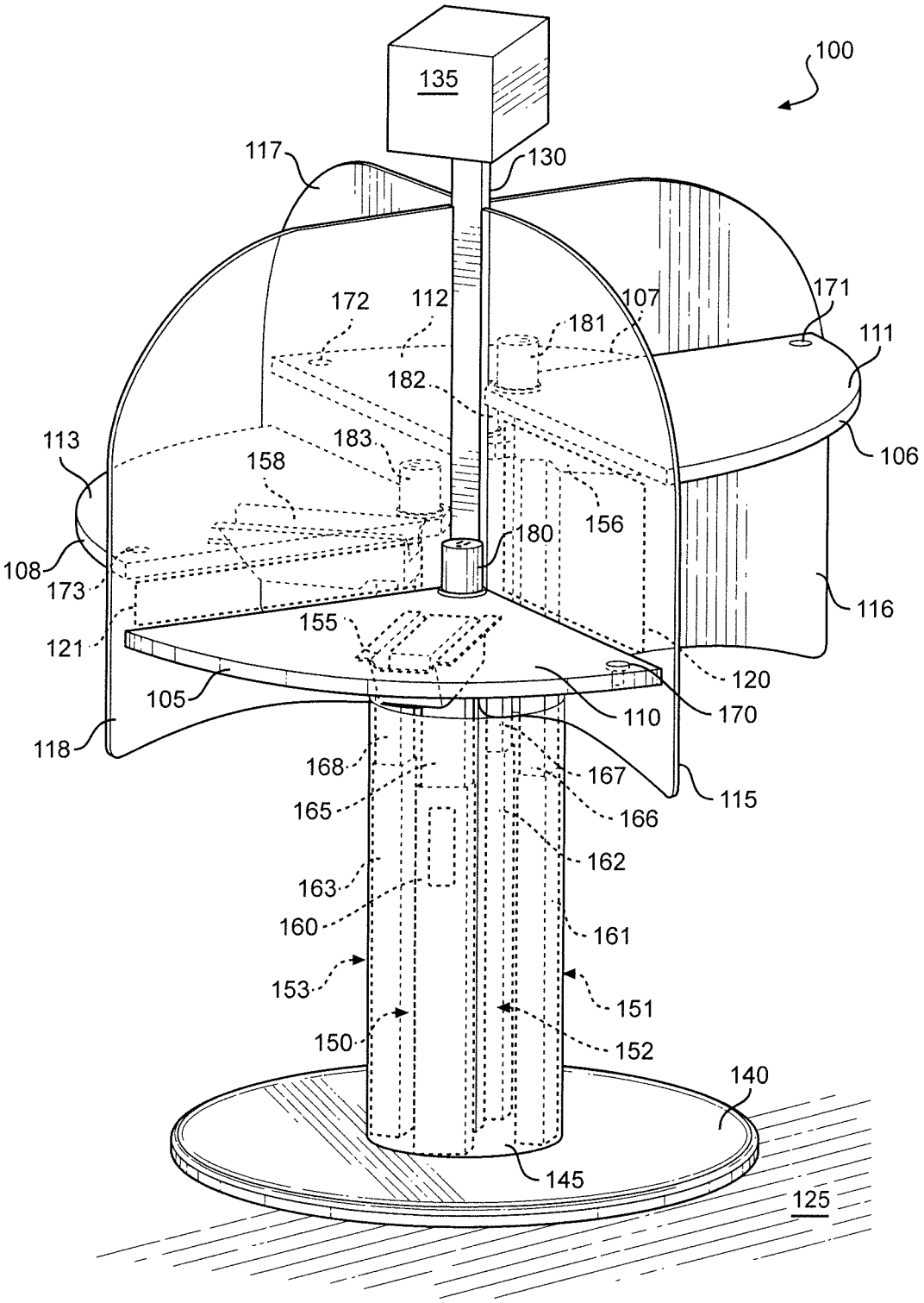
FIG. 1A is a perspective view of a table in accordance with a first embodiment of the present invention.
Figure 1B:
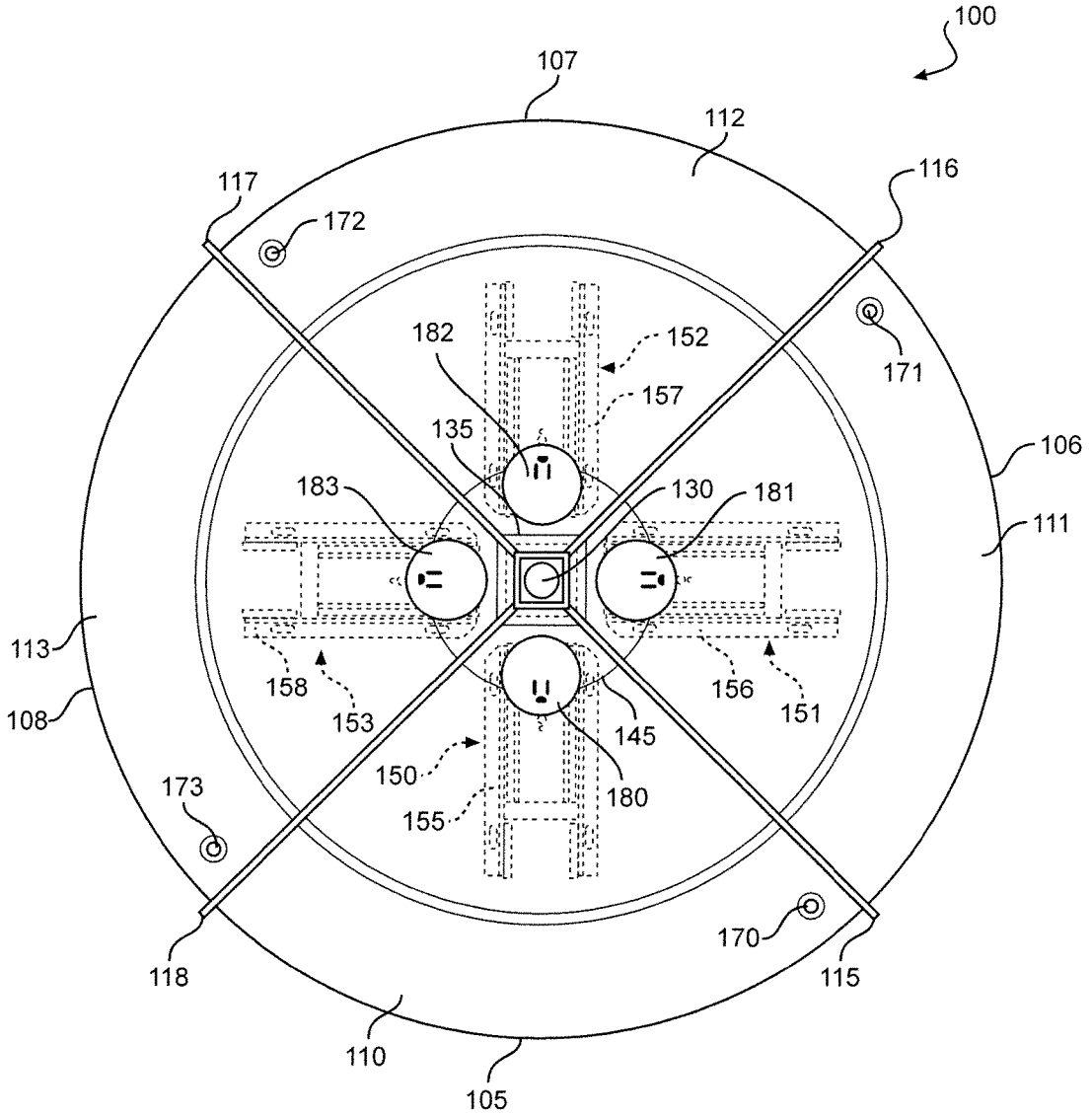
FIG. 1B is a top down view of the table of FIG. 1A.

With initial reference to FIGS. 1A and 1B, there is shown a table 100 in accordance with a first embodiment of the present invention. Table 100 is divided into four tabletops 105-108, which collectively define a geometric shape when table 100 is viewed from above (as in FIG. 1B). In this case, tabletops 105-108 define a circle. However, other shapes can also be used in connection with the present invention. For example, tabletops 105-108 can define an oval, a square, a rectangle or some other polygon. Also, table 100 can be divided into some other numbers of tabletops, e.g., two, three or five. Each of tabletops 105-108 lies along a horizontal plane and includes an upper surface 110-113 on which a user of table 100 can place one or more objects such as electronic devices, documents, pens, etc. In other words, tabletops 105-108 are configured to support physical objects placed thereon by a user.

Tabletops 105-108 are separated by guards 115-118. In the first embodiment, guards 115-118 serve dual functions. First, guards 115-118 eliminate the pinch points that would otherwise exist between adjacent tabletops 105-108. These pinch points are due to the fact that tabletops 105-108 are vertically adjustable, as will be described in more detail below. This means that the relative vertical distance between adjacent tabletops 105-108 can vary. If an object is located between adjacent tabletops 105-108 during a vertical adjustment of one or both tabletops 105-108, the object can be compressed or pinched by the adjacent tabletops 105-108, thereby potentially damaging the object. With respect to tabletop 105 specifically, it can be seen that a first pinch point 120 would exist between tabletops 105 and 106 if guard 115 was not present and that a second pinch point 121 would exist between tabletops 105 and 108 if guard 118 was not present. As should be apparent, corresponding pinch points would also exist between the other tabletops 105-108 if guards 115-118 were removed.

Second, guards 115-118 act as dividers or privacy screens such that when table 100 is placed in a public space, for example, multiple people can use table 100 without worrying that their fellow users can see what they are doing. To accomplish this, guards 115-118 are relatively tall. In particular, guards 115-118 preferably begin at approximately 28 inches (~711 mm) above a support surface 125 on which table 100 rests, which is roughly thigh height for the average human. Guards 115-118 then end at approximately 60 inches (1524 mm) above support surface 125, which is roughly head height for the average human. This results in guards 115-118 being approximately 32 inches (~813 mm) tall. In addition, the height of each guard 115-118 is preferably greater than the vertical distance over which tabletops 105-108 are adjustable.

Guards 115-118 are directly coupled to a central post 130, which is located in a center of table 100. As a result, guards 115-118 are fixed in place vertically, i.e., guards 115-118 do not move when tabletops 105-108 are vertically adjusted. Post 130 extends vertically above guards 115-118, and an optional accessory 135 is shown directly coupled to this portion of central post 130. Since accessory 135 can take a variety of forms, accessory 135 is shown schematically. As one example, accessory 135 can be a sign on which an advertisement is displayed. In another example, accessory 135 can be a display screen, e.g., a television or a computer monitor. Accessory 135 can also be a light that provides illumination to table 100 and the area surrounding table 100. Furthermore, accessory 135 can take the form of one or more shelves for holding office supplies, food service items, etc. Of course, it should be recognized that multiple accessories 135 can be coupled to post 130 (either of the same type or of varying types). Also, post 130 can have no accessory 135 coupled thereto, with post 130 ending at the top of guards 115-118. Accessory 135 can be removably coupled to post 130. Alternatively, at least some portion of accessory 135 can formed integrally with post 130. In addition, post 130 can include multiple, vertically stacked posts (not shown) that are removably coupled to one another. Such an arrangement is especially beneficial when accessory 135 is formed integrally with post 130 because it allows accessory 135 to be removed.

The bottom end of post 130 is directly coupled to a base 140, which is in direct contact with support surface 125. Base 140 can optionally include feet or padding (not shown) on the bottom. In such an arrangement, base 140 is still considered to be in direct contact with support surface 125 since the feet and padding are part of base 140. Preferably, base 140 is weighted so as to provide stability to table 100. In addition, a housing 145 is in direct contact with base 140 and serves to cover the lower portions of post 130 and height adjustment mechanisms 150-153. That is, housing 145 hides the lower portions of post 130 and height adjustment mechanisms 150-153 from view and also prevents foreign objects from interfering with height adjustment mechanisms 150-153, thereby protecting height adjustment mechanisms 150-153. Each of height adjustment mechanisms 150-153 is directly coupled to base 140 at one end and one of tabletops 105-108 at the other end. In particular, height adjustment mechanisms 150-153 include brackets 155-158, which are used to directly couple height adjustment mechanisms 150-153 to tabletops 105-108. As a result, height adjustment mechanisms 150-153 can selectively shift or adjust tabletops 105-108 relative to base 140 and therefore relative to support surface 125. In an alternative arrangement, base 140 can be omitted, and certain portions of table 100 (e.g., post 130 and height adjustment mechanisms 150-153) are secured directly to support surface 125 to provide stability to table 100.

Height adjustment mechanisms 150-153 can take a variety of forms. Preferably, height adjustment mechanisms 150-153 are electric-motor-driven actuators, such as screw-drive linear actuators. However, height adjustment mechanisms 150-153 can also be gear driven, cable driven or pneumatically driven, for example. As shown, height adjustment mechanisms 150-153 include outer shafts 160-163 directly coupled to base 140 and inner shafts 165-168 directly coupled to tabletops 105-108. Outer shafts 160-163 are fixed in place, while inner shafts 165-168 are movable relative to outer shafts 160-163. This shifting of inner shafts 165-168 relative to outer shafts 160-163 results in vertical movement of tabletops 105-108. As noted above though, other arrangements can be used to provide the desired vertical adjustability of tabletops 105-108. Height adjustment mechanisms, in general, are known in the art such that height adjustment mechanisms 150-153 are primarily intended to be exemplary rather than limiting.

Height adjustment mechanisms 150-153 are controlled by user interfaces 170-173, one of which is located at each of tabletops 105-108 so that a person at a given tabletop 105-108 can control its height, i.e., its vertical position relative to support surface 125. Specifically, user interfaces 170-173 sends signals to respective height adjustment mechanisms 150-153 to control height adjustment mechanisms 150-153. Each of user interfaces 170-173 takes the form of one or more buttons located in upper surfaces 110-113. Alternatively, user interfaces 170-173 can be located in the lower surfaces of tabletops 105-108, for example. Preferably, tabletops 105-108 are adjustable over a distance of 20 inches (508 mm) and more preferably over a distance of 12 inches (~305 mm). Also, tabletops 105-108 are preferably adjustable from a minimum height of approximately 36 inches (~914 mm) above support surface 125 to a maximum height of approximately 48 inches (~1219 mm) above support surface, with the specific heights of course dependent upon the distance over which tabletops 105-108 are adjustable. Such a range allows a majority of the population to comfortably use table 100.

Table 100 further includes power outlets 180-183, one of which is coupled to each of tabletops 105-108. Power outlets 180-183 are located on upper surfaces 110-113 so as to be accessible to users of table 100. Preferably, power outlets 180-183 each include one or more AC (alternating current) sockets as well as one or more USB (universal serial bus) ports. Power outlets 180-183 can of course include additional sockets or ports if desired, e.g., Ethernet ports. As a result, a user can charge his or her laptop and smartphone, for example, while using table 100. Preferably, power is routed to power outlets 180-183 through corresponding cables (not shown) located in housing 145. These cables can pass through a hole in base 140 or housing 145 in order to be connected to a mains electricity.

Figure 2:
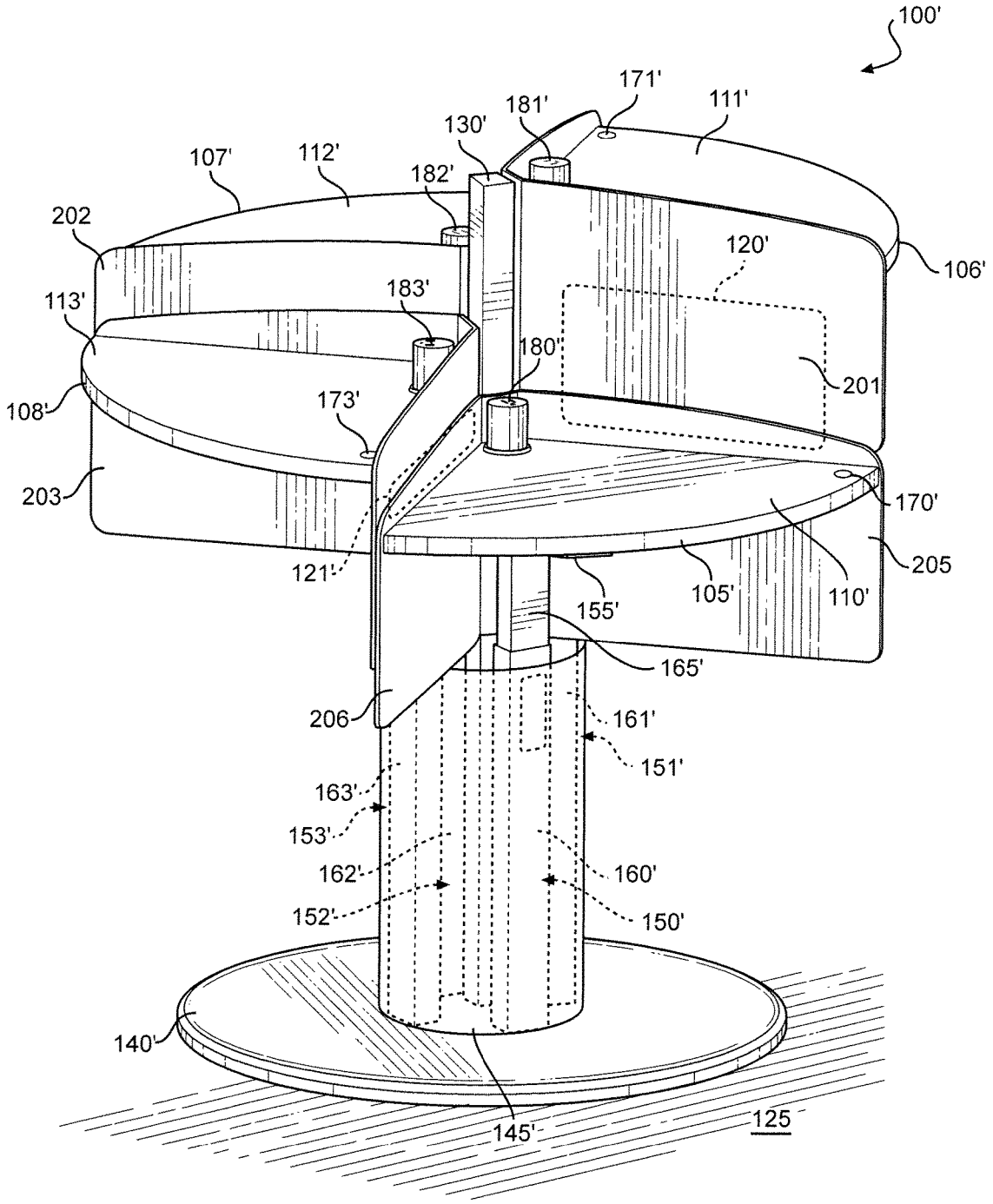
FIG. 2 is a perspective view of a table in accordance with a second embodiment of the present invention.

With reference now to FIG. 2, there is shown a table 100' in accordance with a second embodiment of the present invention. Table 100' generally functions in the same manner and includes the same structure as table 100. Accordingly, table 100' will not be described in as great of detail. The primary difference between table 100' and table 100 relates to guards 200-203. Specifically, rather than having a plurality of relatively tall guards fixed to a central post 130', table 100' includes guards 200-203 that move along with tabletops 105-108' as tabletops 105-108' are shifted vertically by height adjustment mechanisms 150-153'. To accomplish this, guards 200-203 are directly coupled to tabletops 105-108'. As compared with guards 115-118, guards 200-203 are relatively shorter. This is because guards 200-203 are not meant to provide privacy for users of table 100'. Instead, table 100' is intended to be used in a standing meeting, for example, where the users are communicating with one another.

Each of guards 200-203 extends above a respective one of upper surfaces 110-113' of tabletops 105-108'. This arrangement prevents objects from sliding off the sides of tabletops 105-108' and also helps eliminate pinch points between adjacent tabletops 105-108'. Along these lines, each of guards 200-203 also extends below a respective one of tabletops 105-108', with adjacent ones of guards 200-203 overlapping one another along imaginary vertical planes located between adjacent tabletops 105-108'. For example, the overlap of guards 200 and 201 eliminates a pinch point 120' that would otherwise exist along a vertical plane located between tabletops 105' and 106', and the overlap of guards 200 and 203 eliminates a pinch point 121' that would otherwise exist along a vertical plane located between tabletops 105' and 108'. As should be apparent, corresponding pinch points would also exist between the other tabletops 105-108' if guards 200-203 were removed.

In order for guards 200-203 to overlap one another in all tabletop positions, the height of each guard 200-203 is at least equal to, and preferably greater than, the vertical distance over which tabletops 105-108' are adjustable. As discussed above, this vertical distance is preferably 12 to 20 inches (~305 to 508 mm). Accordingly, guards 200-203 are preferably at least 12 to 20 inches (~305 to 508 mm) tall. More preferably, guards 200-203 are 15 inches (381 mm) tall when tabletops 105-108' are adjustable over a 12 inch (~305 mm) range. In such an arrangement, guards 200 are tall enough that vertical movement of tabletops 105-108' does not result in a pinch point being created between adjacent tabletops 105-108'.

Although each of guards 200-203 is shown as extending along both sides of a respective one of tabletops 105-108', separate guards can be used for each side. For example, guard 200 can be replaced with two guards (not shown), one guard being located between tabletops 105' and 106' at a side 205 of tabletop 105' and the other guard being located between tabletops 105' and 108' at a side 206 of tabletop 105'. In addition, guards 200-203 need not extend above upper surfaces 110-113' so long as guards 200-203 extend a sufficient distance below tabletops 105-108' so that adjacent guards 200-203 overlap one another and thereby eliminate any pinch points.

While all of tabletops 105-108 and 105-108' have been shown as being vertically adjustable, it should be recognized that some of tabletops 105-108 or 105-108' can be fixed in place if desired. Also, although height adjustment mechanisms 150-153 and 150-153' are shown as being separate, height adjustment mechanisms 150-153 and 150-153' can be included in common housings.

Based on the above, it should be readily apparent that the present invention provides a standing-height table having individual height-adjustable portions so that the table can be comfortably and conveniently shared by multiple people. Although described with reference to preferred embodiments, it should be readily understood that various changes or modifications could be made to the invention without departing from the spirit thereof. In general, the invention is only intended to be limited by the scope of the following claims.

The invention claimed is:

1. A height-adjustable table comprising:

a first tabletop;

a second tabletop;

a first height adjustment mechanism configured to vertically shift the first tabletop relative to a support surface on which the table is supported;

a second height adjustment mechanism configured to vertically shift the second tabletop relative to the support surface;

a base in direct contact with the support surface, wherein each of the first and second height adjustment mechanisms is directly coupled to the base;

a housing in direct contact with the base, wherein the housing is configured to at least partially cover each of the first and second height adjustment mechanisms;

a central post directly coupled to the base, wherein the housing is further configured to at least partially cover the central post; and a guard directly connected to the central post.

2. The table of claim 1, further comprising an accessory directly coupled to the central post.

3. The table of claim 2, wherein the accessory is a sign, a display screen, a light or a shelf.

4. The table of claim 2, wherein the accessory is removably coupled to the central post.

5. The table of claim 1, wherein the guard is configured to eliminate a pinch point located between the first tabletop and the second tabletop.

6. The table of claim 5, wherein the guard is fixed in place such that the guard does not move when the first and second tabletops are vertically shifted.

7. The table of claim 1, wherein the first and second tabletops define at least a portion of a circle when the table is viewed from above.

8. The table of claim 1, further comprising:

a first user interface configured to control the first height adjustment mechanism; and a second user interface configured to control the second height adjustment mechanism.

9. A method of assembling a height-adjustable table, the table including a first tabletop, a second tabletop, a first height adjustment mechanism configured to vertically shift the first tabletop relative to a support surface on which the table is supported, a second height adjustment mechanism configured to vertically shift the second tabletop relative to the support surface, a base in direct contact with the support surface, a guard and a central post, the method comprising:

directly coupling each of the first and second height adjustment mechanisms to the base;

directly coupling the central post to the base;

directly coupling the guard to the central post; and placing a housing in direct contact with the base, wherein the housing is configured to at least partially cover each of the first and second height adjustment mechanisms and the central post.

10. The method of claim 9, further comprising directly coupling an accessory to the central post.

11. The method of claim 10, wherein directly coupling the accessory to the central post includes directly coupling a sign, a display screen, a light or a shelf to the central post.

12. The method of claim 9, further comprising eliminating a pinch point located between the first tabletop and the second tabletop with the guard.

13. The method of claim 12, further comprising fixing the guard in place such that the guard does not move when the first and second tabletops are vertically shifted.

* * * * *